United States Patent [19]

Malec

[11] 4,201,684

[45] May 6, 1980

[54] LUBRICANT COMPOSITION OF IMPROVED FRICTION REDUCING PROPERTIES

[75] Inventor: Robert E. Malec, Birmingham, Mich.

[73] Assignee: Ethyl Corporation, Richmond, Va.

[21] Appl. No.: 959,934

[22] Filed: Nov. 13, 1978

[51] Int. Cl.[2] ..... C10M 1/38

[52] U.S. Cl. ..... 252/47.5; 252/48.6

[58] Field of Search ..... 252/47.5, 48.6, 402

[56] References Cited

U.S. PATENT DOCUMENTS

| | | | |
|---|---|---|---|
| 2,237,096 | 4/1941 | Dearborn | 252/48.6 X |
| 2,257,752 | 10/1941 | Lincoln et al. | 252/47 X |
| 2,680,718 | 6/1954 | Eby | 252/48.6 |
| 3,509,502 | 4/1970 | Murphy | 252/34.7 |
| 3,873,457 | 3/1975 | Magne et al. | 252/47.5 |

FOREIGN PATENT DOCUMENTS

| | | | |
|---|---|---|---|
| 1038686 | 7/1956 | Fed. Rep. of Germany | 252/47.5 |

OTHER PUBLICATIONS

Magne et al., J. Amer. Oil Chem. Soc.; vol. 51, No. 3, pp. 93–100, 1974.

*Primary Examiner*—Andrew Metz

*Attorney, Agent, or Firm*—Donald L. Johnson; Robert A. Linn; Joseph D. Odenweller

[57] ABSTRACT

Lubricating oil adapted for use as a crankcase lubricant in internal combustion engines containing a friction-reducing amount of a sulfurized fatty acid amide, ester or ester-amide of an oxyalkylated amine.

5 Claims, No Drawings

LUBRICANT COMPOSITION OF IMPROVED FRICTION REDUCING PROPERTIES

BACKGROUND

In order to conserve energy, automobiles are now being engineered to give improved gasoline mileage compared to those in recent years. This effort is of great urgency as a result of Federal regulations recently enacted which compel auto manufacturers to achieve prescribed gasoline mileage. These regulations are to conserve crude oil. In an effort to achieve the required mileage, new cars are being down-sized and made much lighter. However, there are limits in this approach beyond which the cars will not accommodate a typical family.

Another way to improve fuel mileage is to reduce engine friction. The present invention is concerned with this latter approach.

Polyethoxylated oleamide is commercially available under the name "Ethomid" (registered trademark, Armak Company). Reference to its use as a demulsifier in lubricating oil appears in U.S. Pat. No. 3,509,052.

SUMMARY

According to the present invention lubricating oils are provided which reduce friction between sliding metal surfaces in internal combustion engines. The reduced friction results from the addition to the lubricating oil of a small amount of a sulfurized fatty acid amide, ester or ester-amides of alkoxylated amine such as diethanolamine.

DESCRIPTION OF THE PREFERRED EMBODIMENTS

A preferred embodiment of the invention is a lubricating oil composition comprising a major amount of lubricating oil and a minor friction-reducing amount of an additive selected from sulfurized fatty acid esters, sulfurized fatty acid amides and sulfurized fatty acid ester-amides of an alkanol amine, said amine having the formula

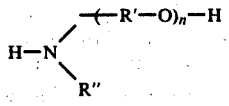

wherein R' is a divalent aliphatic hydrocarbon radical containing 2–4 carbon atoms, n is an integer from 1 to 10, and R'' is selected from hydrogen and the group $+R'O)_n—H$.

The additives can be made by reacting a sulfurized fatty acid with an oxyalkylated amine (e.g. diethanolamine). Alternatively, sulfurized fatty acid amide can be made by reacting sulfurized fatty acid with ammonia or an alkanol amine (e.g. ethanolamine, diethanolamine) to form an intermediate which can be further oxyalkylated by reaction with an alkylene oxide (e.g. ethylene oxide, propylene oxide).

Another method is to first make the fatty acid ester, amide or ester-amide by reacting a fatty acid with an oxyalkylated amine (e.g. diethanolamine) and then reacting that intermediate with elemental sulfur at elevated temperature (e.g. 100° to 250° C.).

Sulfurized fatty acids can be made by heating a mixture of fatty acid with elemental sulfur. Unsaturated fatty acids are preferred such as hypogeic acid, oleic acid, linoleic acid, elaidic acid, erucic acid, brassidic acid, tall oil fatty acids and the like. Sulfurized oleic acid is most preferred. Sulfurized oleic acid is a commercial product.

The preferred amine used to make the additives are ethoxylated amines such as ethanolamine, diethanolamine, isopropylamine and the like. These can be reacted to form both amides and esters. Using diethanolamine as an example, sulfurized oleic acid, (S)oleic, reacts as follows:

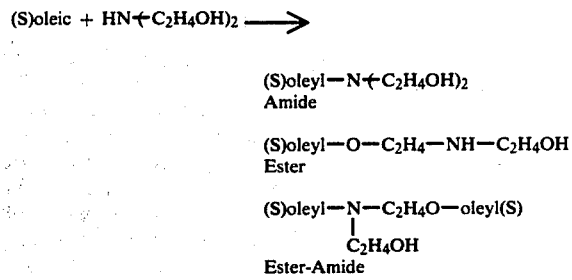

When equal mole amounts of sulfurized fatty acid and diethanolamine are used the product contains mainly amide because of the greater reactivity of the HN< group. With sulfurized oleic acid the product is about 60–90 weight percent amide and 10–40 weight percent ester. Use of larger amounts of fatty acid increases the content of ester-amide components.

The above represents the preferred additives. They can be further reacted with alkylene oxide to form a polyoxyalkylene chain. The following reaction illustrates this:

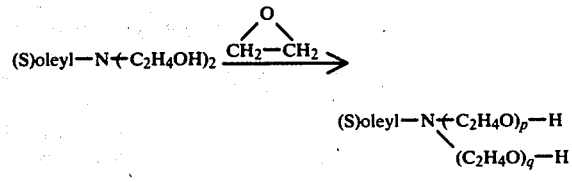

wherein p and q are integers independently selected from 1 to about 10.

Oxyalkylation of the ester components of the product mix would give the following type products:

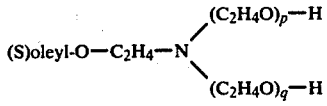

wherein p and q are as above.

Alternatively, the sulfurized fatty acid can be reacted with ammonia to form amide which can then be reacted with alkylene oxide. Using one mole of sulfurized oleamide and (p + q) moles of ethylene oxide this reaction would proceed as follows:

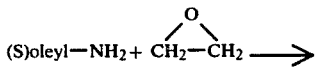

-continued

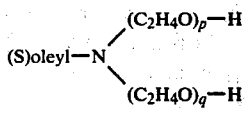

wherein p and q are as above. This method gives amide only without the ester or ester-amide components.

A still further alternate is to follow any of the above methods using unsulfurized fatty acid and to post-react the intermediate product with sulfur at elevated temperatures.

EXAMPLE

In a reaction vessel was placed 308 gms (1 equiv) of a commercial sulfurized oleic acid (Cincinnati Milacron), 105 gms (1 mole) diethanolamine and a small of xylene. The mixture was heated under nitrogen to 185° C. over two hours while removing water. The mixture was then stripped of solvent under vacuum leaving the product. It was analyzed for nitrogen. (Found 3.48 percent total nitrogen, 0.93 percent basic nitrogen.) This shows a mixtutre of 73 weight percent sulfurized oleamide of diethanolamine and 27 weight percent sulfurized oleate ester of diethanolamine.

Other sulfurized fatty acids can be substituted for sulfurized oleic acid in the above example with good results.

The additives are used in an amount sufficient to reduce the sliding friction of metal surfaces lubricated by oil containing the additive. An effective concentration is about 0.05–5 weight percent. More preferably, the use of concentration is about 0.2–1 weight percent.

The base lubricating oil may be mineral lubricating oil or synthetic lubricating oil. Useful mineral oils include all those of suitable lubricating viscosity. Representative synthetic oils include olefin oligomers such as α-decene trimer and tetramer, alkyl benzenes such as didodecyl benzene, esters such as dinonyl adipate, trimethylol propane tripelargonate, and complex esters made from polycarboxylic acids and polyols with a monocarboxylic acid or monohydric alkanol end group.

Blends of mineral oil and synthetic oil are very useful. For example, a blend of about 80% 150 SUS mineral oil and 20% α-decene trimer gives a very useful base lubricating oil. Likewise, blends of synthetic esters with mineral oil are very useful. For example, a blend of 15 weight percent di-2-ethylhexyl adipate and 85 weight percent 150 SUS mineral oil is a very effective base lubricating oil for use in an engine crankcase.

Improved results are obtained when a zinc dihydrocarbyldithiophosphate (ZDDP) is used in combination with the present additives. The amount can vary over a wide range. It is usually expressed in terms of zinc content of the oil. Formulated oil would include 0.01–3 weight percent zinc as ZDDP. A preferred range is about 0.05–0.15 weight percent zinc.

The ZDDP may be aryl type of alkyl type. A representative aryl type ZDDP is zinc di-nonylphenyldithiophosphate. Preferably, an alkyl type ZDDP is used. Examples of these are zinc isobutyl amyl dithiophosphate, zinc di-(2-ethylhexyl)dithiophosphate and the like.

Other additives may be included such as alkaline earth metal phenates and sulfurized phenates, alkaline earth hydrocarbyl sulfonates such as calcium petroleum sulfonate, magnesium alkyl benzene sulfonate, overbased calcium alkyl benzene sulfonate and the like. Phosphosulfurized terpene and polyolefins and their alkaline earth metal salts may be included. Viscosity index improvers such as the poly-alkyl methacrylate or ethylene-propylene copolymers, ethylene-propylene non-conjugated diene terpolymers are also useful VI improvers in lubricating oil. Antioxidants such as 4,4'l -methylenebis-(2,6-di-tert-butylphenol) can be beneficially added to the lubricating oil.

Tests were carried out which demonstrated the friction-reducing properties of the additives. These tests have been found to correlate with fuel economy tests in automobiles. In these tests an engine with its cylinder head removed and with the test lubricating oil in its crankcase was brought to 1800 rpm by external drive. Crankcase oil was maintained at 63° C. The external drive was disconnected and the time to coast to a stop was measured. This was repeated several times with the base oil and then several times with the same oil containing one percent of a mixture prepared as described in the Example. The base oil was a typical commercial oil formulated for use in a crankcase. The friction-reducing additive was found to increase the coast-down time an average of 6.1%.

I claim:

1. A lubricating oil composition comprising a major amount of lubricating oil and a minor friction-reducing amount of an additive selected from sulfurized fatty acid esters, sulfurized fatty acid amides and sulfurized fatty acid ester-amides of an alkanol amine, said amine having the formula

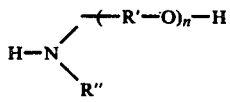

wherein R' is a divalent aliphatic hydrocarbon radical containing 2–4 carbon atoms, n is an integer from 1 to 10, and R'' is selected from hydrogen and the group $+R'O)_n—H$.

2. A composition of claim 1 wherein said sulfurized fatty acid is sulfurized oleic acid.

3. A composition of claim 2 wherein said additive comprises a sulfurized oleamide of diethanolamine.

4. A composition of claim 2 wherein said additive comprises a sulfurized oleate ester of diethanolamine.

5. A composition of claim 2 wherein said additive comprises a mixture containing about 60–90 weight percent sulfurized oleamide of diethanolamine and about 10–40 weight percent sulfurized oleate ester of diethanolamine.

* * * * *